US006401616B1

(12) United States Patent
Strobel et al.

(10) Patent No.: US 6,401,616 B1
(45) Date of Patent: Jun. 11, 2002

(54) METHOD AND MATERIAL FOR MAKING A COATING BLANKET FOR USE IN PRINTING PRESSES

(75) Inventors: Wolfgang M. Strobel, Tolland; Dana Seniff, South Glastonbury, both of CT (US)

(73) Assignee: Gerber Scientific Products, Inc., South Windsor, CT (US)

( * ) Notice: Subject to any disclaimer, the term of this patent is extended or adjusted under 35 U.S.C. 154(b) by 0 days.

(21) Appl. No.: 09/566,897

(22) Filed: May 8, 2000

(51) Int. Cl.[7] ..... B41N 6/00

(52) U.S. Cl. ..... 101/401.1; 400/616.3; 428/195

(58) Field of Search ..... 101/217, 227, 101/401.1, 483; 226/2, 3, 6; 400/616.1, 621, 616.3; 281/2; 428/195, 40.1, 41.3, 41.8, 41.9, 42.3, 43, 45, 47, 48, 77, 78, 79, 99, 138, 140

(56) References Cited

U.S. PATENT DOCUMENTS

| | | | | | |
|---|---|---|---|---|---|
| 4,759,484 | A | * | 7/1988 | Richter | 226/6 |
| 4,867,363 | A | * | 9/1989 | Wood et al. | 400/616.3 |
| 5,026,584 | A | * | 6/1991 | Logan | 428/195 |
| 5,466,501 | A | * | 11/1995 | Logan et al. | 428/138 |
| 5,551,786 | A | * | 9/1996 | Webster et al. | 400/616.3 |
| 5,713,288 | A | | 2/1998 | Frazzitta | |
| 5,765,481 | A | * | 6/1998 | Tortora et al. | 101/227 |
| 5,771,809 | A | | 6/1998 | Hecht | |
| 5,808,654 | A | * | 9/1998 | Loos | 400/616.1 |
| 5,810,494 | A | * | 9/1998 | Menard et al. | 400/616.3 |
| 6,044,761 | A | | 4/2000 | Hecht | |

FOREIGN PATENT DOCUMENTS

| | | |
|---|---|---|
| GB | 2110584 A | 6/1983 |
| GB | 2133731 A | 12/1983 |
| GB | 2178686 A | 2/1987 |
| GB | 2188170 A | 9/1987 |

* cited by examiner

*Primary Examiner*—Eugene Eickholt
(74) *Attorney, Agent, or Firm*—McCormick, Paulding & Huber LLP

(57) ABSTRACT

A method for cutting coating blanket material for use in a printing press includes providing a cutting apparatus having a frame and a cutting surface extending across the frame. A support is mounted to the frame adjacent and approximately parallel to the cutting surface and carries a cutter head mounted thereon for motion back and forth across the support. A drag-type knife is coupled to the cutter head and is movable between a working position wherein the knife penetrates a first layer of flexible material defined by the coating blanket material, and a non-working position wherein the knife is located above the coating blanket material. During operation, the coating blanket moves back and forth through the cutting apparatus while the knife simultaneously places lines of cut in the coating blanket material in accordance with commands issued from a controller having coating blanket cutting data stored therein.

8 Claims, 4 Drawing Sheets

METHOD AND MATERIAL FOR MAKING A COATING BLANKET FOR USE IN PRINTING PRESSES

FIELD OF THE INVENTION

The present invention is generally directed to the application of coatings onto print media, and is more specifically directed to a method for making a coating blanket for applying a coating solution onto the print media.

BACKGROUND OF THE INVENTION

In printing items such as brochures, product packages, and the like, it is often desirable to enhance the durability or scratch resistance of the finished product, or to achieve a certain visual or tactile effect, such as a matte or glossy finish. In general, this is accomplished by selectively applying different coatings onto the print media. Usually, the coating is applied by passing the printed media, such as cardboard, under a roller or other surface having what is referred to by those skilled in the art as a "coating blanket" attached thereon. The coating blanket is covered with a coating solution and engages the print media as it passes under the blanket. The coating solution is typically referred to by those skilled in the pertinent art to which the invention pertains, as "varnish."

To apply varnish only to certain portions of the print media, areal portions of the coating blank corresponding to non-coated areas on the print media are cut from the coating blanket. Normally, the coating blanket material is cut by hand introducing the likelihood of human error to the cutting process. In addition manually cutting the coating blanket results in long production times that cause corresponding increases in the cost associated with producing the final product.

In the past efforts to automate the coating blanket production process have been attempted. For example, flat bed type cutting machines wherein the coating blanket material is positioned on a flat surface and remains stationary while a numerically controlled knife traverses and cuts the material have been utilized. However, these machines are usually quite large and very expensive. Moreover, positioning the coating blanket material on the flat surface can be quite cumbersome since an operator must reach over the flat surface to orient the coating blanket.

Based on the foregoing, it is the general object of the present invention to provide a method for producing a coating blanket that overcomes the problems and drawbacks of prior art methods.

SUMMARY OF THE INVENTION

The present invention is directed to a method and material for making a coating blanket for use in printing presses wherein the coating blanket material includes at least a first layer of flexible material having an upper and a lower surface, and a second layer of semi-rigid material bonded to the lower surface of the first layer. A cutting machine is provided that includes a frame, a cutting surface mounted for rotation to the frame and adapted to engage the second layer of semi-rigid material, and thereby support the coating blanket material. Means for driving the coating blanket material in a first and second direction with the second direction being opposite to the first direction are also included, the means being responsive to commands issued from a controller having coating blanket cutting data stored therein. A support is mounted to the frame adjacent to and coaxial with the cutting surface and a cutter head is mounted to the support for movement back and forth therealong responsive to the cutting data stored in the controller. A knife for cutting the first layer of flexible material is also provided and is coupled to the cutter head for movement between a working position wherein the knife engages and extends through the first layer of flexible material, and a non-working position wherein the knife is positioned above the first layer of flexible material.

To facilitate a cutting operation, the coating blanket material is presented to the cutting apparatus with the second layer of semi-rigid material engaging the cutting surface and the upper surface of the first layer of flexible material facing the cutter head. During operation, the drive means causes the coating blanket material to move back and forth in the first and second directions responsive to the cutting data stored in the controller. Simultaneously, the cutter head moves relative to the upper surface of the coating blanket material, also in response to commands issued from the controller with the knife moving between the non-working and working positions, thereby generating lines of cut in the upper layer of flexible material. The operation continues until all of the cuts necessary to complete the desired coating blanket are made. Preferably, the knife is a drag-type knife pivotally mounted to the cutter head such that during a cutting operation, movement of the cutter head relative to the coating blanket material causes the knife to orient itself along a particular line of cut.

In one embodiment of the present invention, the second layer of semi-rigid material defines opposing lateral edge portions, each extending past a corresponding edge of the first layer of flexible material. A plurality of apertures are defined by each of the lateral edge portions with each aperture in one of the lateral edge portions being approximately aligned with a corresponding aperture in the other of the lateral edge portions. In this embodiment, the apertures are adapted to engage drive pins, which extend radially from a pair of sprockets, one of which is mounted to the frame adjacent to each end of the cutting surface.

Preferably, the apertures defined by the lateral edge portions as well as the drive pins extending from each sprocket are arranged in a pattern, thereby allowing the coating blanket material to be mounted onto the cutting apparatus in only one way. This prevents the possibility of mounting the coating blanket material to the cutting apparatus in a misaligned manner. In addition, the aperture pattern as well as the drive pin pattern on the sprockets can be employed to enable the controller to determine the position of the coating blanket material relative to the knife. For example, where a single differently sized drive pin or a series of differently sized drive pins are employed in the above-described sprockets, an encoder or other type of sensor can detect the position of the differently sized pin, thereby allowing the controller to determine the orientation and position of the coating blanket relative to the knife and the cutting data stored in the controller.

Due to the weight and rigidity of typical coating blanket materials, as the material is advanced through the cutting apparatus, significant overhang of coating blanket material relative to the cutting surface can develop. This overhung material results in large torque requirements to move the material back and forth through the cutting apparatus. To address this situation, another embodiment of the present invention is directed to the formation of a loop of coating blanket material mounted on the cutting apparatus. To form the loop, a sheet of coating blanket material is mounted on the cutting apparatus with a portion of the semi-rigid second layer being supported by the cutting surface. The coating blanket material is then wrapped around the cutting surface and the ends of the material are joined together such that the loop of coating blanket material encompasses the cutting surface. This prevents the coating blanket material from overhanging the cutting surface during a cutting operation, thereby requiring less torque to be generated by the drive means to move the coating blanket material back and forth relative to the cutter head. In fact, the drive means in this embodiment must only overcome the coating blanket material's own inertia.

In each of the above-described embodiments, it may be desirable to cut sharp corners into the first layer of coating blanket material. To accomplish this, it is preferable that the knife of the present invention be a drag knife pivotally mounted to the cutter head such that the motion of the cutter head and coating blanket material relative to one another causes the knife to pivot and orient itself along the desired line of cut. To produce sharp corners, the present invention employs a method whereby the motion of the cutter head and the coating blanket material is halted, and the knife is moved from a position wherein it was cutting through the thickness of the first layer of flexible material to a point where a tip defined by the knife just contacts the upper surface of the first layer of flexible material. Next, the cutter head and the coating blanket material are moved relative to one another an amount sufficient to cause the drag knife to pivot and align itself with the knife's cutting edge facing the desired direction necessary to form the angle defined by the corner. The drag knife is then plunged through the first layer of flexible material but not to a point where it would cut or score the second layer of semi-rigid material, and the cutting operation is continued.

An advantage of the present invention lies in the fact that the above-described method of creating a coating blanket does not rely on a manual cutting operation and thereby eliminates any potential for human error.

In addition, coating blankets can be created wherein the cut areas are formed with greater precision than would be possible in a manual operation.

Another advantage of the present invention is the incorporation of a drag knife as opposed to numerically controlled knives used in flat-bed type machines that require complex mechanisms to manipulate the knife, whereas a drag knife simply pivots relative to the direction of cut.

DETAILED DESCRIPTION OF THE PREFERRED EMBODIMENTS OF THE PRESENT INVENTION

Figure 1:
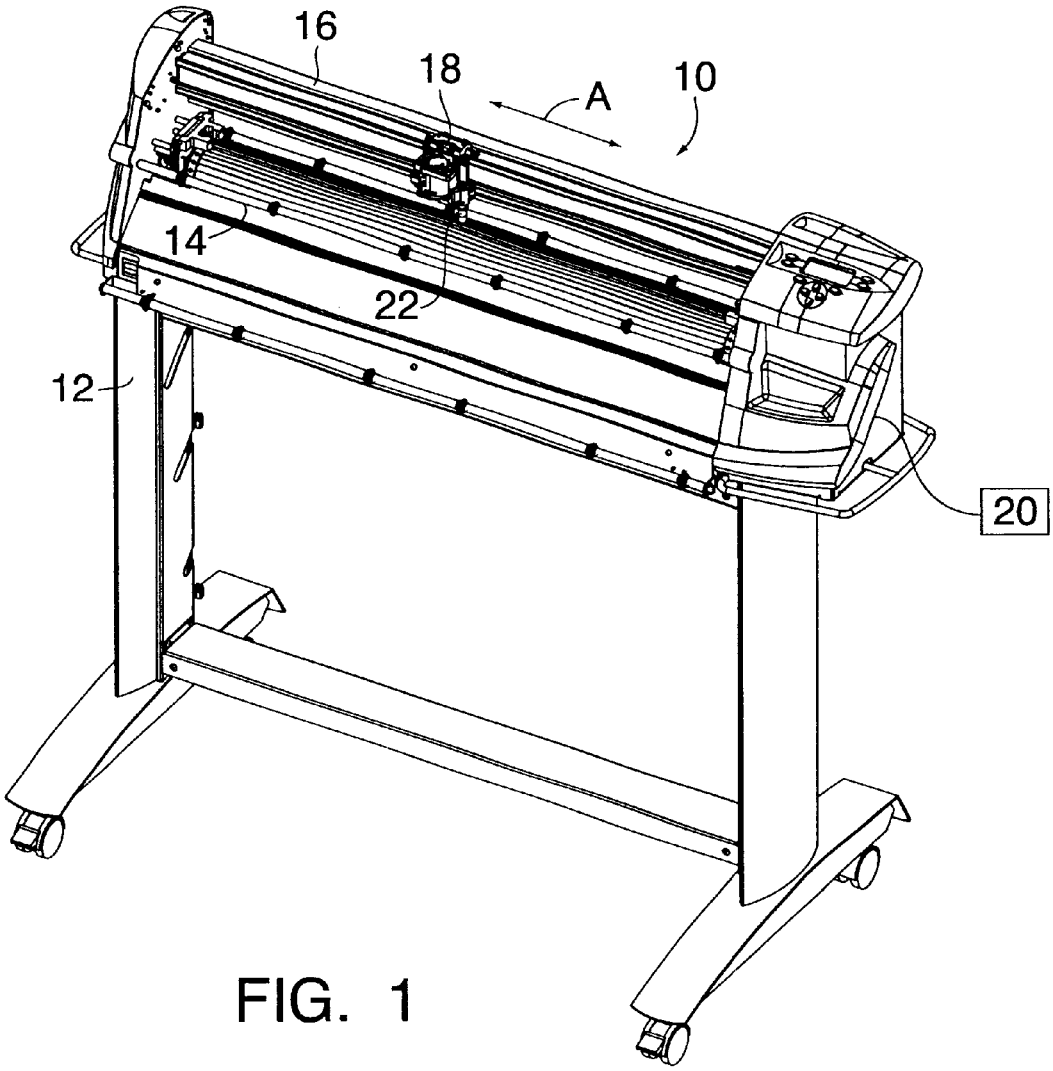
FIG. 1 is an isometric view of a cutting apparatus useful in practicing the method of the present invention.

As shown in FIG. 1, a cutting apparatus generally designated by the reference number 10 includes a frame 12 having a cutting surface 14 mounted thereon. The cutting surface 14 extends across the frame 12, and as will be explained in detail below, is adapted to support a sheet of coating blanket material. A support 16 is also mounted to the frame 12 and is adjacent and approximately perpendicular to the cutting surface 14. A cutter head 18 is mounted to the support 16 for movement back-and-forth along the support as indicated by the arrows labeled "A" in response to commands issued from a controller 20 in communication with the cutting apparatus 10 and having coating blanket cutting data stored therein in a machine readable format. A knife 22 is pivotally mounted to the cutter head 18 and is movable, responsive to said coating blanket cutting data, between a working position wherein said knife engages and cuts said coating blanket material, and a non-working position wherein said knife is positioned above said coating blanket material.

Figure 2:
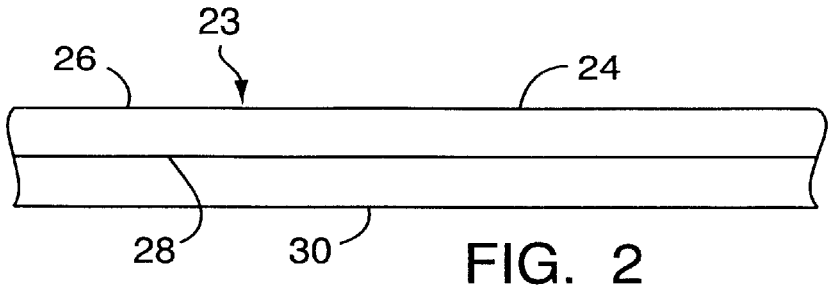
FIG. 2 is a partial side elevational view of the coating blanket material of the present invention showing the first layer of flexible material and the second layer of semi-rigid material.

As shown in FIG. 2, the coating blanket material 23 includes a first layer of flexible material 24 having an upper surface 26 and a lower surface 28. Preferably the first layer is formed from a suitable material such as, but not limited to polyurethane. A second layer 30 of semi-rigid polymeric material is bonded via an adhesive to the lower surface 28 of the first layer 24 thereby forming a laminate. Preferably, the adhesive employed allows the first layer 24 to be peeled from the second layer, with the second layer having such release characteristics that substantially all of the adhesive remains bonded to the lower surface 28 of the first layer of flexible material. In the preferred embodiment of the present invention, the second layer 30 is formed from a polymer, such as, but not limited to polyester.

Figure 3:
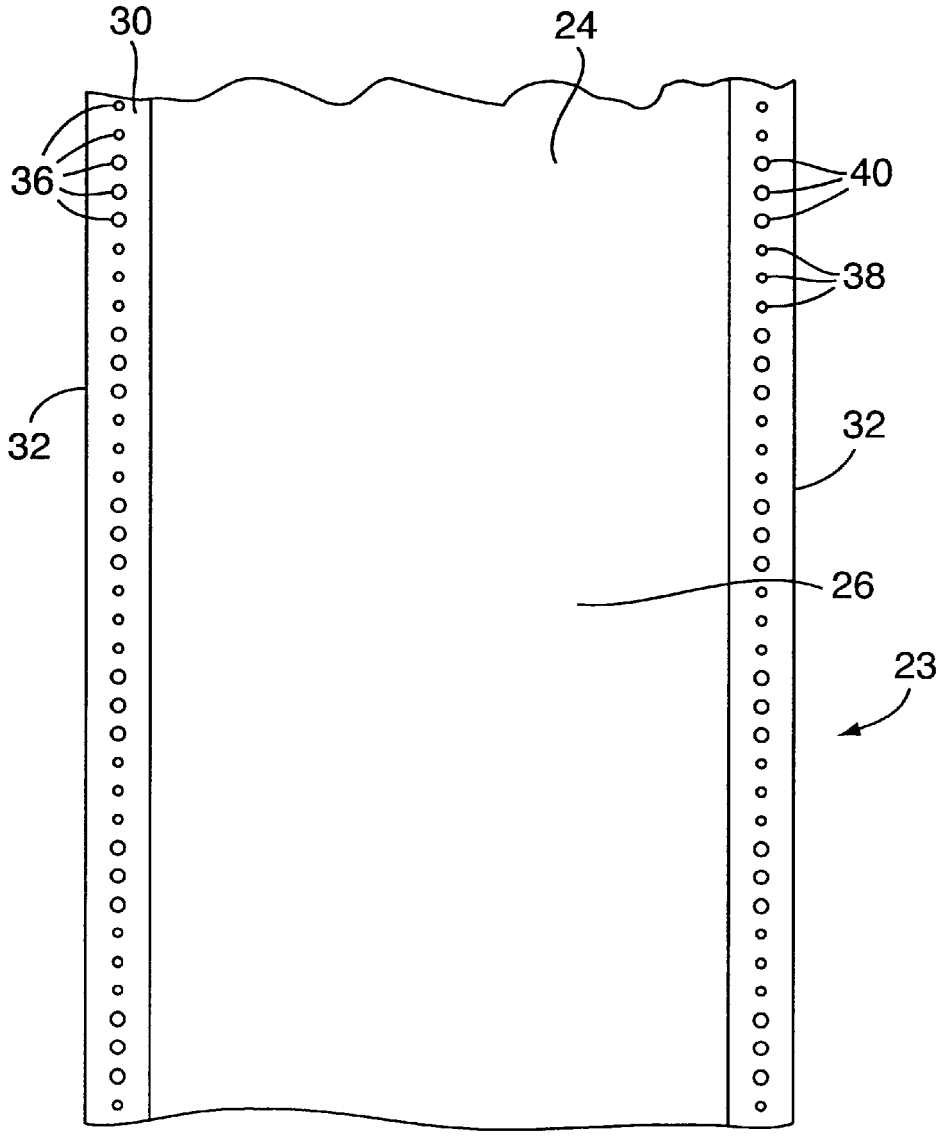
FIG. 3 is a plan view of an embodiment of the coating blanket material of FIG. 2 showing opposed lateral edges defined by the second layer of semi-rigid material having a plurality of apertures extending therethrough.

Turning to FIG. 3, an embodiment of the above described coating blanket material includes a pair of opposing lateral edge portions 32 defined by the second layer 30 of semi-rigid polymeric material. Each lateral edge portion 32 extends outwardly from a corresponding edge portion 34 of the first layer of flexible material 24 and defines a plurality of apertures generally designated by the reference numeral 36 extending therethrough. Each aperture 36 in one of said lateral edge portions 32 is approximately aligned with a corresponding aperture in the other of said lateral edge portions. In the illustrated embodiment of the present invention, the apertures are positioned in a repeating pattern of a first series of smaller apertures 38 followed by a second series of larger apertures 40. The reasons for, and the use of these apertures will be explained in detail below.

Figure 4:
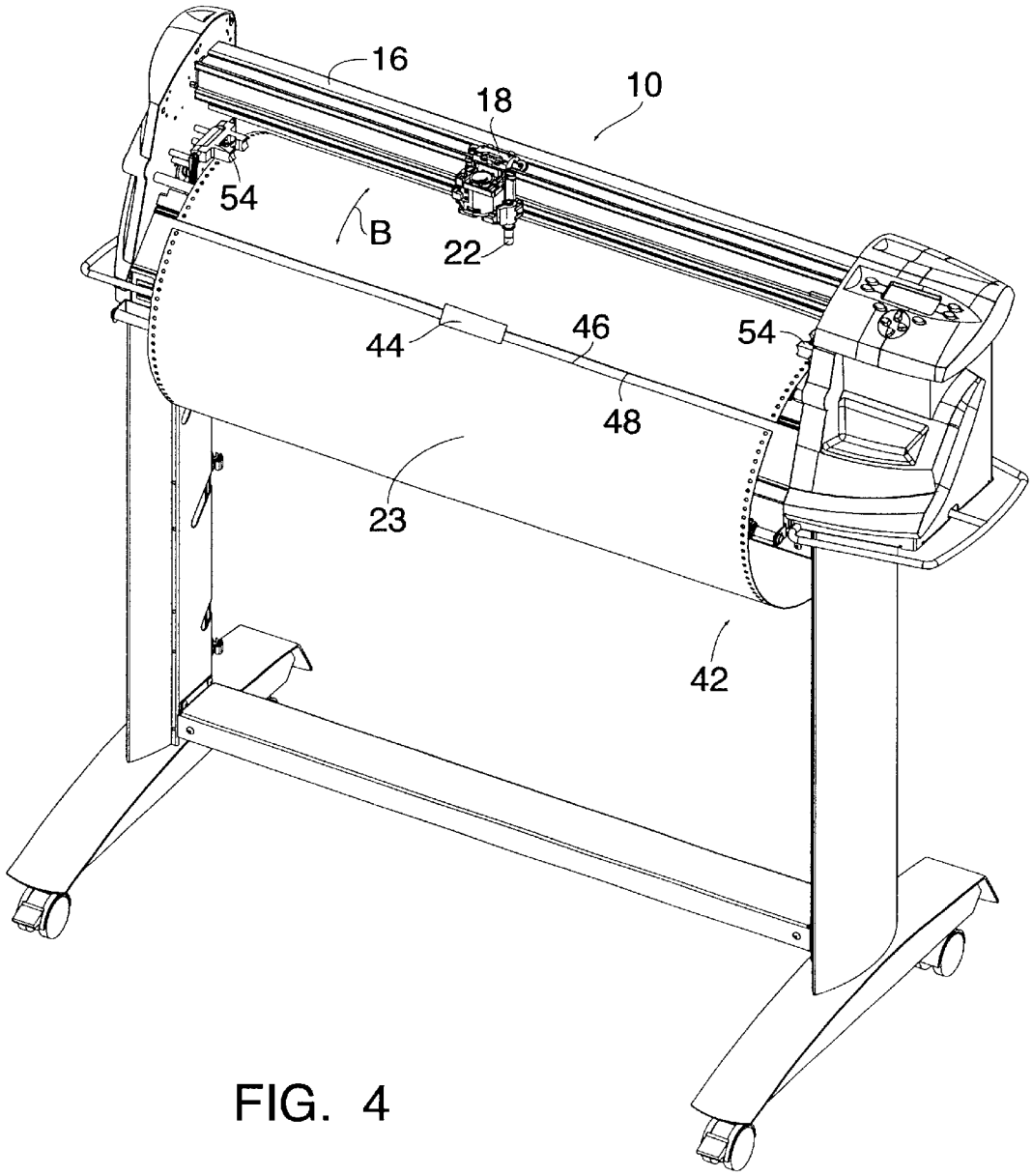
FIG. 4 is an isometric view of the cutting apparatus of FIG. 1 showing the coating blanket material mounted thereon in the form of a loop.

As shown in FIG. 4, the coating blanket material 23 is mounted on the cutting apparatus 10 in the form of a loop 42 that encompasses the cutting surface 14. To retain the coating blanket material 23 in the form of the loop 42, at least one clip 44 is employed to releasably retain the ends 46 and 48 of the coating blanket material adjacent to one another. In this manner, the coating blanket material 23 does not hang in a vertical orientation as it is advanced over the cutting surface 14, which due to gravity and the relatively large mass of the coating blanket material would require the cutting apparatus to generate large torque in moving the coating blanket material through the cutting apparatus. By forming the coating blanket material into a loop, the cutting apparatus 10 need only overcome the material's inertia in order to move the coating blanket material over the cutting surface. While a clip 44 has been shown and described, the present invention is not limited in this regard as other fastening means such as tape or adhesive can be employed without departing from the broader aspects of the present invention.

Figure 5:
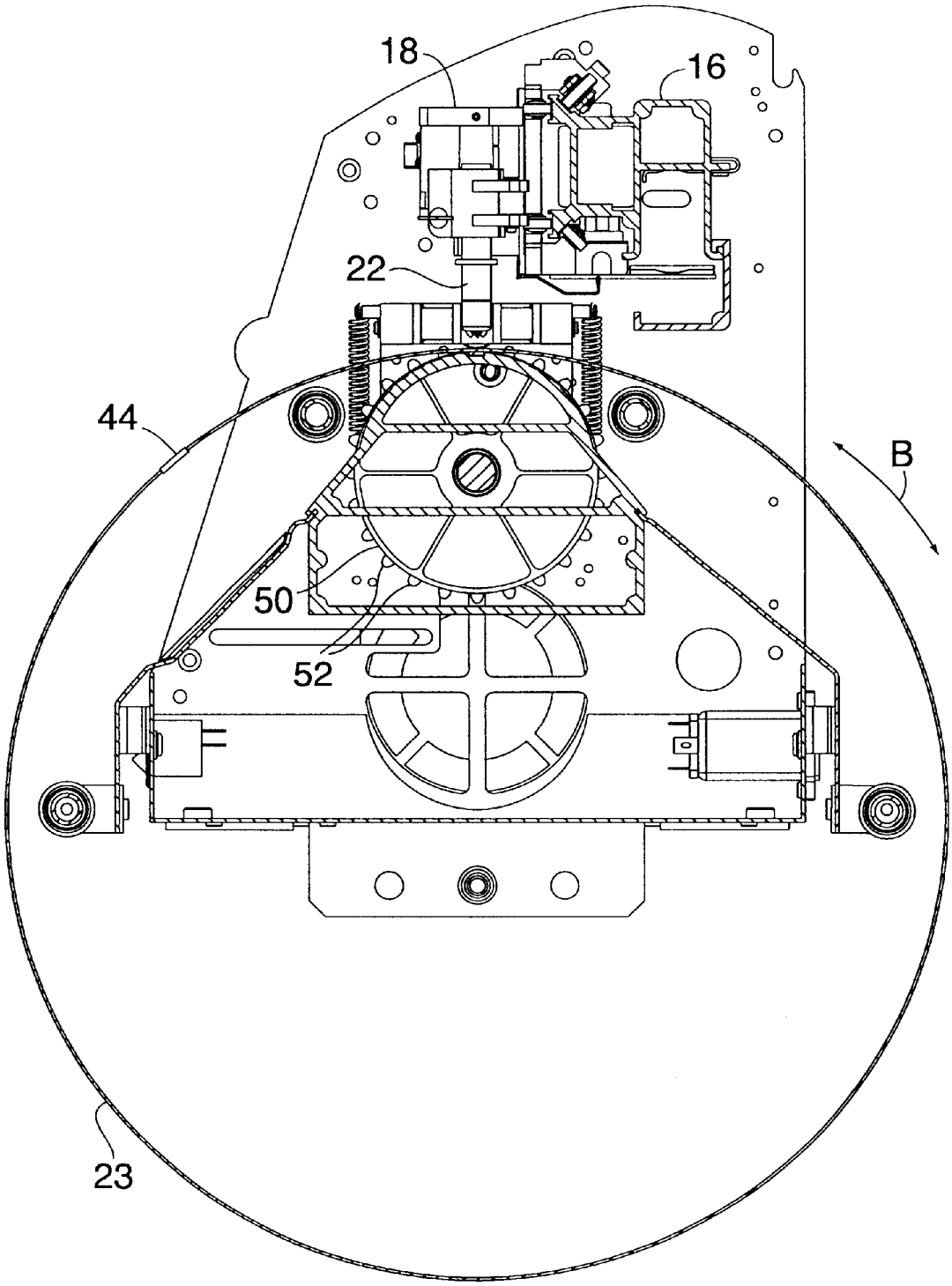
FIG. 5 is a partial cross sectional view of the apparatus of FIG. 5 showing one of a pair of drive sprockets engaging apertures extending through lateral edge portions defined by the second layer of semi-rigid material.

Referring to FIG. 5, a pair of drive sprockets 50 (only one shown) is rotatably mounted to the frame 12 each adjacent to a respective end of the cutting surface 14. At least one of the drive sprockets 50 is coupled to a suitable drive (not shown) such as but not limited to a stepper motor or servo responsive to commands issued from the controller 20 for angularly rotating the sprocket 50 back and forth in a first and second angular direction, the second angular direction being generally opposite to the first angular direction. Each of the drive sprockets 50 define a plurality of radially extending drive pins 52 adapted to engage the apertures 36 defined by the opposed lateral edge portions 32 of the second layer of semi-rigid material 30. The drive pins 52 can vary in size and be arranged in a pattern to conform to the aperture pattern defined by the opposed lateral edge portions of the second layer of semi-rigid material shown in FIG. 3. While a particular aperture and drive pin pattern has been illustrated, the present invention is not limited in this regard as any number of different aperture and drive pin patterns can be employed without departing from the broader aspects of the present invention.

A pair of retaining arms 54, FIG. 4, are hingedly mounted to the frame 12, one of the retaining arms being located adjacent to each drive sprocket 50. Each retaining arm 54 is movable between a raised position to allow the apertures 36 defined by the opposed lateral edges of the to be positioned over the drive pins 52 defined by each drive sprocket 50, and a lowered position to retain the coating blanket material 23 on the pair of drive sprockets during a cutting operation.

During operation, the coating blanket material 23 is loaded into the cutting apparatus 10 by aligning the apertures 36 defined by the lateral edge portions 32 of the second layer of semi-rigid material with the drive pins 52 extending from each of the above-described drive sprockets 50. In response to commands issued from the controller in accordance with the coating blanket cutting data stored therein, the drive sprockets 50 move the coating blanket material 23 back and forth in the first and second directions as indicated by the arrow B, FIG. 4. As the coating blanket material is being moved by the drive sprocket 50, the cutter head 18, also in response to commands issued from the controller, traverses back and forth along the support. During the motion of the cutter head 18, the knife 22 moves between the working position wherein it penetrates through the first layer of flexible material, but does not score or cut the second layer of semi-rigid material, and the non-working position wherein the knife is located above the coating blanket material. This process continues until all of the desired lines of cut are made in the first layer of flexible material.

Often, it is desirable to form lines of cut that correspond to a sharp corner. As will be recalled, the knife 22 is a drag-type knife pivotally mounted to the cutter head 18 such that changes in the direction of motion of the cutter head relative to the coating blanket causes the knife to pivot and follow a new line of cut. To form a sharp corner, the motion of the cutter head 18 and the coating blanket material 23 is halted and the knife 22 is lifted to its non-working position and held there for a time sufficient to allow both the knife material and the first layer of working position until it just touches the upper surface of the first layer of flexible material. The cutter head 18 and coating blanket material 23 are then moved relative to one another in an amount sufficient to cause the knife 22 to pivot such that it is oriented at an angle corresponding to a desired line of cut as well as a desired angle for forming the sharp corner. The knife 22 is then plunged through the first layer of flexible material to a point sufficient to cut through the first layer without scoring or cutting the second layer of semi-rigid material. The cutter head 18 and coating blanket material 23 are then moved relative to one another along the desired line of cut in accordance with commands issued from the controller responsive to the cutting data stored therein. While the above-described embodiments of the present invention have incorporated a sprocket-type drive system for moving the coating blanket material 23 back and forth through the cutting apparatus 10, the present invention is not limited in this regard. Other types of drive systems known to those skilled in the pertinent art to which the invention pertains, such as a friction or grit wheel-type drive can be employed without departing from the broader aspects of the present invention.

It is to be understood that the form of the invention shown and described herein is to be taken as a preferred embodiment of the same, and that various changes in the selection of parts comprising the broadly defined means and in the arrangement of said parts may be resorted to without departing from the spirit of the invention or the scope of the following claims.

What is claimed is:

1. A method for cutting coating blanket material for use in a printing press, comprising the steps of:

providing said coating blanket material having at least a first layer of flexible material defining an upper and lower surface, and a second layer of semi-rigid material attached to said lower surface of said first layer;

providing a controller having coating blanket cutting data stored therein in machine readable format;

providing a cutting apparatus in communication with said controller, said cutting apparatus having, a frame and a cutting surface extending across said frame, drive means for moving said coating blanket material back-and-forth in a first and second direction over said cutting surface in response to said cutting data, said second direction being generally opposite said first direction; said cutting apparatus further including, a support mounted to said frame adjacent and approximately parallel to said cutting surface, a cutter head mounted to said support for movement back-and forth relative thereto responsive to said cutting data, and a knife coupled to said cutter head for movement between a working position wherein said knife extends through said first layer, and a non-working position wherein said knife is located above said coating blanket material;

presenting said coating blanket material to said cutting apparatus such that said second layer of semi-rigid material engages said cutting surface;

causing said drive means to move said coating blanket material back-and-forth in said first and second directions, approximately perpendicular to said cutting surface axis in response to commands issued from said controller;

moving said cutter head, responsive to said cutting data back-and-forth along said support during movement of said coating blanket material; and moving said knife between said working and non-working positions in response to commands issued from said controller thereby selectively cutting through portions of said first layer of flexible material without cutting or scoring said second layer of semi-rigid material.

2. A method for cutting sheet-type coating blanket material for use in a printing press as defined by claim 1, wherein:

said knife is a drag-type knife pivotally mounted to said cutter head, such that during a cutting operation when said knife is in said working position the movement of said cutter head and said coating blanket material relative to each other causes said knife to pivotally orient itself along a desired line of cut;

said cutting data includes data stored in said controller corresponding to the cutting of sharp corners;

said step of causing said drive means to move said coating blanket material includes halting the motion of said coating blanket material prior to cutting one of said sharp corners;

said step of moving said knife includes moving said knife from said working position to a position wherein a tip defined by said knife touches said upper surface of said first layer once said motion of said cutting surface is halted; and wherein said method includes the further steps of moving said cutter head and said coating blanket material relative to one another to orient said knife along a line of cut to form said sharp angle; and causing said knife to plunge through said first layer of flexible material thereby forming said sharp corner.

3. A method for cutting sheet-type coating blanket material for use in a printing press as defined by claim 1, wherein:

said semi-rigid second layer includes a pair of opposed lateral edge portions each extending past a corresponding edge of said first layer of flexible material and defining a plurality of sprocket holes, each sprocket hole in one of said opposed lateral edge portions being approximately aligned with a corresponding sprocket hole in the other of said opposed lateral edge portions;

said cutting apparatus includes a pair of drive sprockets each rotatably coupled to said frame adjacent to an end of said cutting surface, each sprocket defining a plurality of radially extending drive pins adapted to engage said plurality of sprocket holes defined by said lateral edge portions of said second layer of semi-rigid material; and said step of presenting said coating blanket material to said cutting apparatus includes aligning said sprocket holes in said opposed lateral edge portions with said drive pins defined by said sprockets.

4. A method for cutting sheet-type coating blanket material for use in a printing press as defined by claim 3, wherein said sprocket holes and said drive pins are arranged in a pattern to prevent misalignment of said coating blanket material when said coating blanket material is presented to said cutting apparatus.

5. A method for cutting sheet-type coating blanket material for use in a printing press as defined by claim 1, wherein subsequent to said step of moving said knife between said working and non-working positions, said method includes the further steps of:

removing said coating blanket material from said cutting apparatus; and generating a plurality of apertures in each of a pair of opposed ends defined by said coating blanket material, said apertures being adapted to engage mounting pins extending from a cutting surface coupled to said printing press thereby allowing said coating blanket material to be mounted to said printing press cutting surface.

6. A method for cutting sheet-type coating blanket material for use in a printing press as defined by claim 1, wherein said step of presenting said coating blanket material to said cutting apparatus includes:

forming said coating blanket material into a loop by releasably attaching opposing ends of said coating blanket material to one another causing said loop to encompass said cutting surface thereby requiring less torque to move said loop back-and-forth in said first and second directions than would be required if said coating blanket material was presented to said cutting apparatus such that during a cutting operation said coating blanket material hangs in a vertical orientation as it is advanced over said cutting surface wherein it is acted upon by gravity.

7. A method for cutting sheet-type coating blanket material for use in a printing press as defined by claim 6, wherein:

said second layer of semi-rigid material includes a pair of opposed lateral edge portions each extending past a corresponding edge of said first layer of flexible material and defining a plurality of sprocket holes, each sprocket hole in one of said opposed lateral edge portions being approximately aligned with a corresponding sprocket hole in the other of said opposed lateral edge portions;

said cutting apparatus includes a pair of drive sprockets each rotatably coupled to said frame adjacent to an end of said cutting surface, each sprocket defining a plurality of radially extending drive pins adapted to engage said plurality of sprocket holes defined by said lateral edge portions of said second layer of semi-rigid material; and said step of presenting said coating blanket material to said cutting apparatus further includes aligning said sprocket holes in said opposed lateral edge portions with said drive pins defined by said sprockets.

8. A method for cutting sheet-type coating blanket material for use in a printing press as defined by claim 7, wherein said sprocket holes and said drive pins are arranged in a pattern to prevent said coating blanket material from being misaligned relative to said sprockets.

* * * * *